United States Patent [19]

Lydon

[11] Patent Number: 4,887,322

[45] Date of Patent: Dec. 19, 1989

[54] AUTOMATIC TOILET SEAT LOWERING APPARATUS

[76] Inventor: Michael J. Lydon, 91 Main St., Concord, Mass. 01742

[21] Appl. No.: 32,598

[22] Filed: Apr. 1, 1987

[51] Int. Cl.[4] ..... A47K 13/10

[52] U.S. Cl. ..... 4/251; 4/248; 4/661

[58] Field of Search ..... 4/251, 248, 236, 661, 4/253; 16/84

[56] References Cited

U.S. PATENT DOCUMENTS

| | | | |
|---|---|---|---|
| 428,001 | 5/1890 | Kaley | 4/251 |
| 752,321 | 2/1904 | Bacon | 4/251 |
| 1,051,508 | 1/1913 | Miller | 4/248 U X |
| 1,073,253 | 9/1913 | Lavelle | 4/248 U X |
| 2,477,378 | 7/1949 | Jurinak | 4/248 |
| 2,700,788 | 2/1955 | Hennelly | 16/86 |
| 4,195,372 | 4/1980 | Farina | 4/234 |
| 4,477,933 | 10/1984 | Lackie | 4/251 X |
| 4,491,991 | 1/1985 | Harbruck | 4/661 |
| 4,577,350 | 3/1986 | Clark | 4/251 |

*Primary Examiner*—Henry K. Artis
*Assistant Examiner*—J. Casimer Jacyna
*Attorney, Agent, or Firm*—Henry C. Nields

[57] ABSTRACT

A toilet seat lowering device for a hinged seat and cover assembly. The device is either made of resilient material or is a spring-like mechanism which is placed on the cover of a toilet near the hinge. When the seat is manually raised the device is compressed and will repel the seat and prevent the seat from remaining in a raised position.

8 Claims, 3 Drawing Sheets

AUTOMATIC TOILET SEAT LOWERING APPARATUS

BACKGROUND OF THE INVENTION

1. Field of the Invention

This invention relates to the type of conventional toilet seat assembly which has both a hinged seat and cover assembly.

2. Description of the Prior Art

A common problem with conventional toilet seat assemblies of the aforementioned type is that the seat is often left in its upright position after use, thereby resulting in an unattractive appearance as well as requiring the next user to return the seat to its lowered position. Numerous toilet seat lowering and lifting devices are known in the prior art, but each of them suffers from one or more among various drawbacks such as difficulty of installation, high cost, frequent malfunctioning, limited accessability for cleaning purposes, unattractive appearance, etc. Some prior art devices require a specialized toilet construction. Other prior art devices may be installed on existing equipment, but many such prior art devices require substantial modifications of the existing equipment to which they are attached. Often such modifications are such that, when the device is removed, permanent damage results.

Among the seat lowering devices of the prior art is that disclosed in U.S. Pat. No. 2,236,466 to Cashwell. This patent discloses an automatic seat lowering device which is activated by opening the bathroom door. In this way the seat is lowered when the user exits the facility. The mechanism is primarily for outdoor application.

U.S. Pat. No. 2,563,095 to Beyrodt discloses an electrically driven mechanism wherein a push button assembly activates a solenoid which causes the seat to be lowered. A spring arrangement causes the seat to move back to an open, vertical position where it is sterilized by ultraviolet radiation.

U.S. Pat. No. 3,504,385 to Fields discloses a toilet seat lifter which is operated by a foot pedal. The foot pedal is connected to a lever assembly which has a right angle rod at its opposite end, said right angle rod being connected to the underside of the toilet seat. When the foot pedal is depressed, the toilet seat is raised to a position short of vertical. Constant force is necessarily applied to the foot pedal to prevent the lowering of the seat, unless the seat is manually placed past the vertical position. A hydraulic cylinder may be employed so that when force is removed from the foot pedal, the seat gradually descends to its lowered position.

U.S. Pat. No. 3,516,095 to Clifton, et al. discloses a double action toilet seat lifting and lowering device operated by means of a foot pedal. Depressing the foot pedal both raises and lowers the seat, the latter occurring with the aid of gravity and a cushioning mechanism.

U.S. Pat. No. 4,195,372 to Farina discloses an automatic seat return device which comprises a leaf spring assembly which is attached to the pintle rod of the hinge mechanism of the toilet seat at a centrally arcuately-bent portion. Two leaf portions extend outwardly from the central arcuately-bent portion and engage the seat cover and seat to provide resiliency therebetween.

U.S. Pat. No. 4,402,092 to Smallwood discloses a spring-biased device attached to a hinged toilet seat which urges the seat to either its upright or horizontal position. The device also has a gear-driven shaft and a clutch which operate to adjust the rate of ascent or descent of the seat.

U.S. Pat. No. 4,551,866 to Hibbs discloses an automatic seat lowering device including a cylinder and piston assembly. When the toilet seat is manually raised to the vertical position, the piston is pulled upwardly and thereby compresses a spring. The compressed spring in turn urges the piston to return to the lower position. A retarding mechanism is employed so as to delay this lowering until the user is finished.

It is an object of the present invention to provide an unobtrusive, inexpensive, easily installable device for the automatic lowering of conventional toilet seats of the aforementioned type.

It is a further object of the present invention to provide an automatic seat lowering device which is simple in construction and can be easily removed without damage to the toilet seat assembly.

Other objects and advantages of the present invention will become apparent from the following description when read with reference to the accompanying drawings.

SUMMARY OF THE INVENTION

The present invention provides an inexpensive, easily installed toilet seat lowering device for any toilet which has both a hinged seat and cover assembly. The device is a spring-like mechanism or resilient material placed between the seat and cover of the toilet assembly. Upon the manual raising of the seat past the position of vertical equilibrium by the manual effort of the user, the spring-like device is compressed thereby resulting in a force which repels this manual effort and tends to push the seat back again past the position of vertical equilibrium. The user is required to hold the seat in the position thus achieved during use to prevent the seat from falling to its lowered position. When the user has finished, he will consequently guide the seat to the lowered position.

DESCRIPTION OF THE PREFERRED EMBODIMENTS

Figure 2:
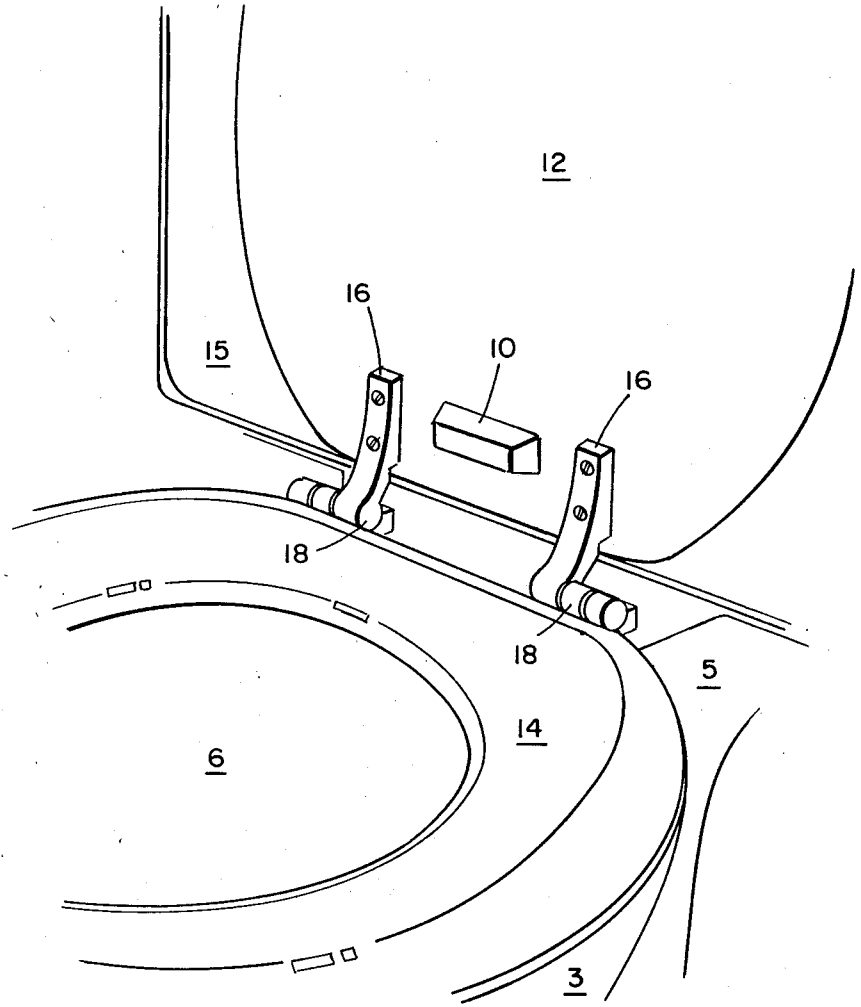
FIG. 2 is a perspective view of a portion of the toilet of FIG. 1, showing the relationship between the seat, the cover, the tank and one form of the spring-like mechanism of the present invention.
Figure 1:
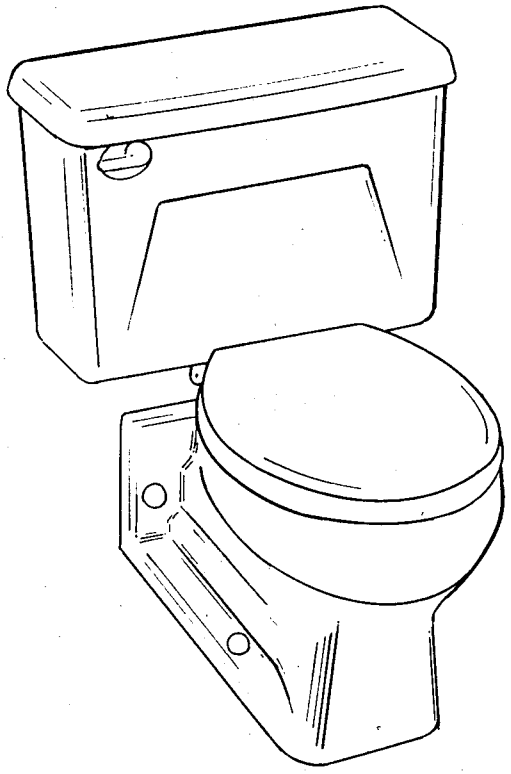
FIG. 1 is a diagrammatic view of the main elements of a toilet which has both a hinged seat and cover assembly and also a tank.

Referring to the drawings and first to FIGS. 1 and 2 thereof, the toilet therein shown includes a tank 15, a bowl 3, a seat 14 and a cover 12. The seat 14 and the cover 12 are supported by hinges 18 upon an axle No Ref. Numeral affixed to the bowl 3. In the closed position the seat 14 rests on the bowl 3 and the cover 12 rests on the seat 14. In the open position of a conventional construction the cover 12 rests on the tank 15 and the seat 14 may rest either on the tank 15 in an essentially horizontal position or the bowl 3 in an essentially stable quasi-vertical position. As the seat 14 is moved from the horizontal position to the stable quasi-vertical position it passes through a position of unstable vertical equilibrium (i.e. a true "vertical" position). If caused to rest in this position of unstable vertical equilibrium the seat 14 will remain there briefly, but the slightest disturbance will cause it to fall either onto the tank 15 or onto the bowl 3. Differently stated, the position of unstable vertical equilibrium is the position at which the seat 14 has maximum potential energy.

In accordance with the invention, a spring-like mechanism 10 is supported between the seat 3 and the cover 12. The spring-like mechanism 10 is deformed when the seat 3 is compressed against the cover 12. The properties of the spring-like mechanism 10 are such that, as the seat 14 is moved from the horizontal position towards the position of unstable vertical equilibrium, deformation of the spring-like mechanism 10 commences just before the seat 14 reaches the position of unstable vertical equilibrium and increases until the seat 14 is stopped by the cover 14, resting against the tank 15, at its aforementioned quasi-vertical position. However, owing to the spring-like mechanism 10 of the invention, the quasi-vertical position is no longer stable. The properties of the spring-like mechanism 10 are such that the stress produced by the deformation (strain) is sufficient to push the seat 14 away from the tank 15 past the position of unstable vertical equilibrium as soon as the compression is released.

Various embodiments of the spring-like mechanism 10 of the invention will now be described with reference to FIGS. 2–6.

In each of FIGS. 2–5 there is shown a conventional toilet assembly 5 with a hinged cover 12 in an upright open position and a hinged seat 14 in a downward closed position. The seat 14 is resting on bowl 3 and defines an opening 6. The hinges 18 are attached to the seat cover 12 via brackets 16. The cover 12 is shown resting against tank 15.

Turning now to FIG. 2, there is shown a foam type bumper spring system 10 affixed to seat cover 12 between brackets 16. The foam type device 10 may be affixed to cover 12 using any conventional adhesive capable of withstanding this particular environment. The foam device 10 must have sufficient resiliency so as to repel seat 14 back past the point of unstable vertical equilibrium when seat 14 is lifted against cover 12 thereby compressing foam device 10. Foam device 10 should also be sufficiently elastic so it will relax when said compression is terminated, and should have a hard outer skin to protect it during cleaning. Foam device 10 compresses sufficiently to allow cover 12 to close the opening 6 when lowered onto seat 14.

Figure 3:
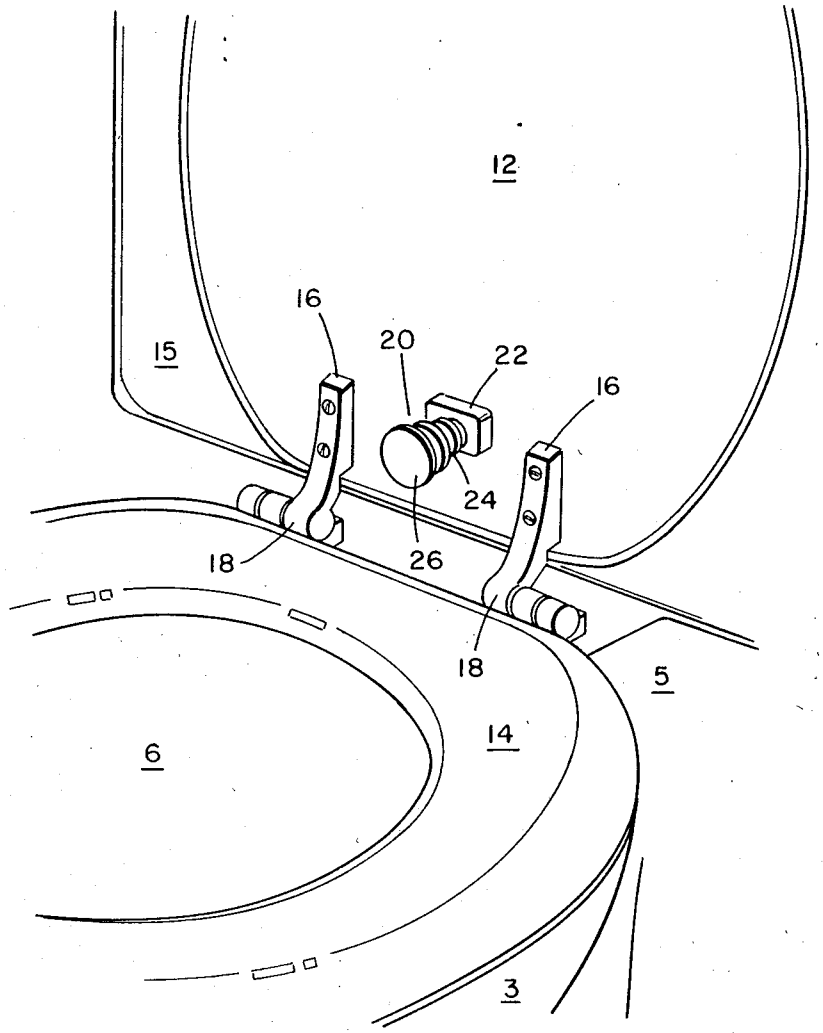
FIG. 3 is a view similar to that of FIG. 2, showing another form of the spring-like mechanism of the present invention.

FIG. 3 illustrates a second embodiment of the present invention. Automatic seat lowering device 20 is affixed to seat cover 12 between brackets 16 via adhesive block 22. A spring-like mechanism 24 extends outwardly from block 22, terminating in a bumper cap 26. Spring-like mechanism 24 may be formed of metal or plastic. Bumper cap 26 may be formed of plastic or rubber and provides a cushion at the point of contact between seat 14 and device 20.

Figure 4:
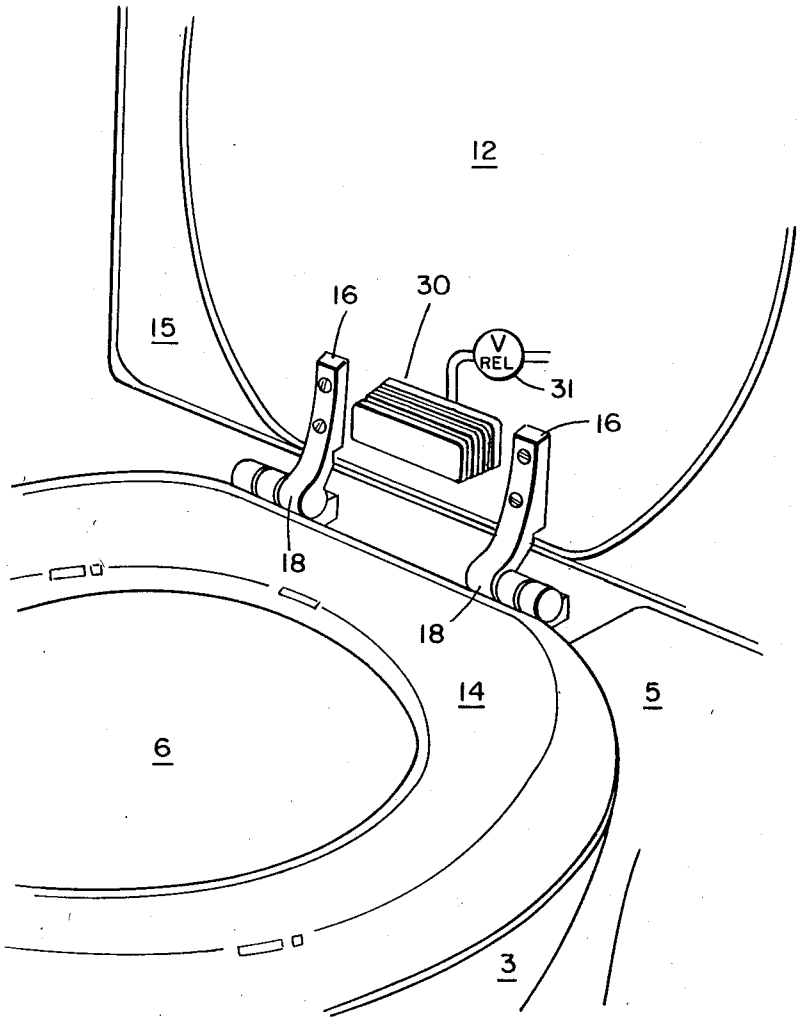
FIG. 4 is a view similar to that of FIG. 2, showing a third form of the spring-like mechanism of the present invention.

FIG. 4 shows another embodiment of the automatic seat lowering device of the present invention. A blow molded bellows spring bumper mechanism 30 is depicted operably attached to seat cover 12 between brackets 16. The mechanism 30 also contains a small relief valve (not shown) which allows cover 12 to close in the down position. The mechanism 30 is attached to cover 12 by adhesive means.

Figure 5:
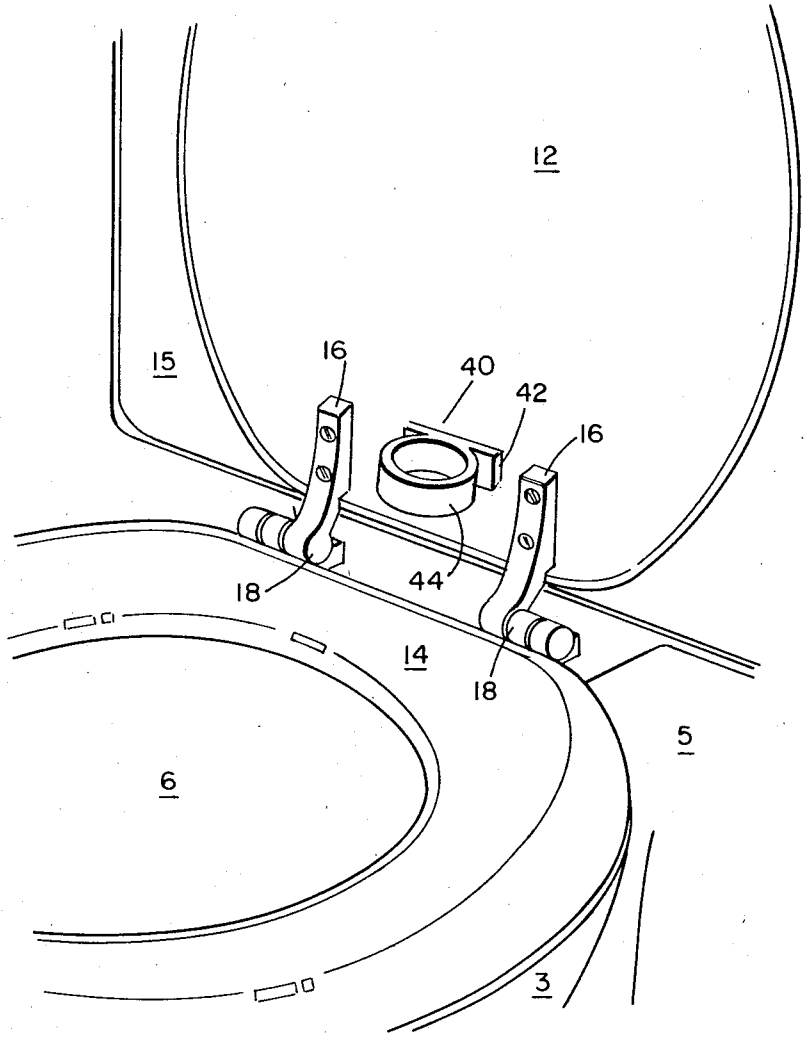
FIG. 5 is a view similar to that of FIG. 2, showing a fourth form of the spring-like mechanism of the present invention.

FIG. 5 illustrates another automatic seat lowering device in accordance with the present invention. The device 40 is adhesively attached to cover 12 via block 42. Extending outwardly from block 42 is a spring bumper device 44. The portion 44 is a ring-like protrusion integrally attached to block 42. Bumper device 44 compresses when engaged by seat 14, and repels seat 14 back past its point of unstable vertical equilibrium. When seat cover 12 is lowered to its down position onto seat 14, the device 40 compresses sufficiently to allow cover 12 to close the opening 6.

Figure 6:
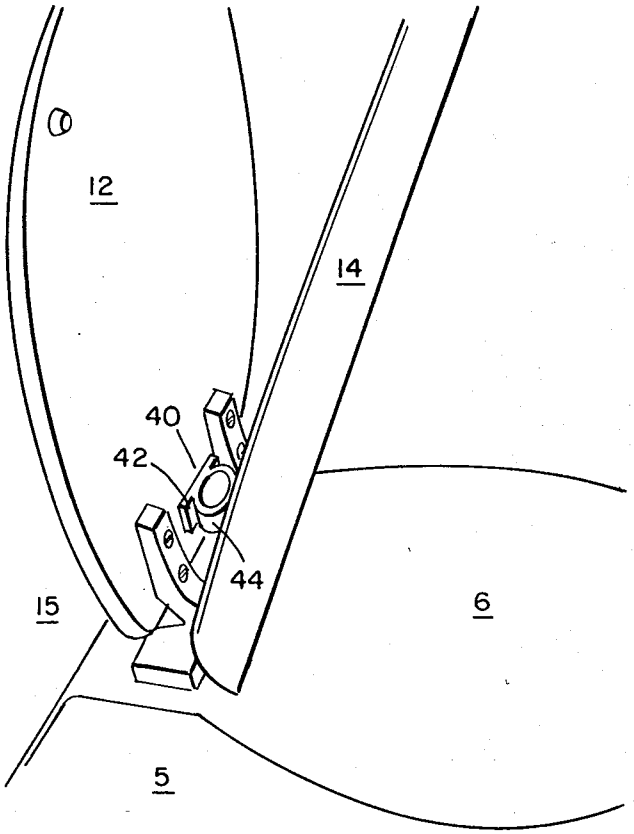
FIG. 6 is a view similar to FIG. 5, showing one embodiment of the present invention during operation.

FIG. 6 illustrates the device 40 in operation. Seat 14 is shown in a raised position at a point just prior to unstable vertical equilibrium. Contact is established between seat 14 and spring bumper device 44, thereby compressing said bumper device 44. Continued movement of seat 14 towards cover 12 results in continued compression of device 44. Owing to the spring-like properties of device 40, the stress produced by the compression pushes the seat 14 away from the cover 12 and past the position of unstable vertical equilibrium as soon as the compression is released.

The foregoing disclosure and description of the invention are illustrative and explanatory thereof, and various changes in the size, shape and materials, as well as in the details of the illustrated construction may be made without departing from the spirit of the invention.

I claim:

1. In combination with a toilet having a bowl, a hinge mounted on said bowl, an apertured seat mounted on said hinge, a seat cover mounted on said hinge, and a support member mounted in fixed relationship to said bowl and adapted to support said cover and said seat when in the raised position, compression means adapted to be compressed only when said seat cover and seat are mutually adjacent and to prevent said seat from remaining in the raised position unless held there by human intervention, said compression means being mounted on said cover in proximity to said hinge, said compression means being small enough so as not to interfere with use of said toilet and large enough to be compressed by said seat when in the raised position, said compression means having resiliency adapted to the pressures characteristic of mechanical advantage inherent in its proximity to said hinge and thus being sufficient so that, when said seat is released from its raised position, said compression means immediately repels said seat away from said cover and past the position of unstable vertical equilibrium.

2. The combination of claim 1 wherein the compression means comprises a helical compression spring having a seat-engaging end, a securing end and means for mounting said securing end to said cover so that said seat-engaging end is positioned to engage said seat.

3. The combination of claim 2 wherein said means for mounting said securing end to said cover comprises an adhesive.

4. The combination of claim 2 wherein said seat-engaging end includes cap to provide a cushion at the point of contact between said seat and said device.

5. The combination of claim 2 wherein said means for mounting said securing end to said cover includes a screw.

6. The combination of claim 5 wherein said means for mounting said securing end is attached to said hinge.

7. The combination of claim 1 wherein the compression means comprises a mounting base and a foam bumper spring integral to said base.

8. The combination of claim 1 wherein the compression means comprises a compressible ring portion forming a spring bumper, and a mounting block integral to said compressible ring portion and having means for adhesive attachment to said cover.

* * * * *